US007739961B2

(12) United States Patent
East et al.

(10) Patent No.: US 7,739,961 B2
(45) Date of Patent: Jun. 22, 2010

(54) LOW PROFILE SHEAR PAD AND ADAPTER

(75) Inventors: David M. East, Mundelein, IL (US); Giuseppe Sammartino, Mount Prospect, IL (US); Ronald D. Golembiewski, Chicago, IL (US)

(73) Assignee: Standard Car Truck Company, Park Ridge, IL (US)

( * ) Notice: Subject to any disclaimer, the term of this patent is extended or adjusted under 35 U.S.C. 154(b) by 96 days.

(21) Appl. No.: 11/963,366

(22) Filed: Dec. 21, 2007

(65) Prior Publication Data

US 2009/0158957 A1 Jun. 25, 2009

(51) Int. Cl.
*B61F 5/26* (2006.01)

(52) U.S. Cl. ..... 105/218.1; 105/224.1; 105/225

(58) Field of Classification Search ..... 105/218.1–2, 105/219, 220, 221.1, 224.1, 225
See application file for complete search history.

(56) References Cited

U.S. PATENT DOCUMENTS 3,274,955 A * 9/1966 Thomas ..... 105/224.1
3,699,897 A * 10/1972 Sherrick ..... 105/218.1
4,236,457 A 12/1980 Cope
4,552,074 A 11/1985 Mulcahy et al.
5,081,935 A 1/1992 Pavlick
5,237,933 A 8/1993 Bucksbee
5,261,332 A 11/1993 Grandy
5,404,826 A 4/1995 Rudibaugh et al.
5,562,045 A 10/1996 Rudibaugh et al.
5,799,582 A 9/1998 Rudibaugh et al.
5,918,547 A 7/1999 Bullock et al.
6,178,894 B1 1/2001 Leingang
6,234,083 B1 5/2001 Tack, Jr.
6,347,588 B1 2/2002 Leingang
6,422,155 B1 7/2002 Heyden et al.
6,524,681 B1 * 2/2003 Seitz et al. ..... 428/143
6,591,759 B2 7/2003 Bullock
6,874,426 B2 4/2005 Forbes
7,017,498 B2 3/2006 Berg et al.
7,121,212 B2 10/2006 Schorr et al.
7,174,837 B2 2/2007 Berg et al.
7,513,199 B2 * 4/2009 Van Auken ..... 105/218.1

* cited by examiner

*Primary Examiner*—S. Joseph Morano
*Assistant Examiner*—Zachary Kuhfuss
(74) *Attorney, Agent, or Firm*—Cook Alex Ltd.

(57) ABSTRACT

A low profile mounting assembly for use between a rail car side frame pedestal and the rail car roller bearing includes a shear pad and a bearing adapter. In one embodiment, the shear pad has relatively thin plates joined by an elastomeric layer. In another embodiment, the shear pad includes a projection extending downwardly from a plate to be received and retained by a recess defined in a top surface of the adapter. In another embodiment, a central cavity formed in a lower plate of the shear pad cooperates with the adapter top surface to distribute forces on the roller bearing. In another embodiment, an elastomeric projection of a shear pad plate bears against ridges on the adapter top surface to prevent disengagement.

10 Claims, 15 Drawing Sheets

LOW PROFILE SHEAR PAD AND ADAPTER

BACKGROUND OF THE INVENTION

1. Field of the Invention

The present invention relates to a mounting assembly used in a railroad car truck and adapted to be positioned between a side frame pedestal and the roller bearing, and more specifically, to such a mounting assembly having a relatively low profile or thickness.

2. Description of Related Art

Mounting assemblies including a shear pad and mating roller bearing adapter have long been known in railroad car trucks for supporting the truck side frames on the wheelsets. Initially, such mounting assemblies included shear pads using metal wear surfaces which permitted limited lateral and longitudinal movement of the side frames relative to the roller bearing adapters positioned on the wheelsets. Subsequently, elastomeric mountings took the place of the metal wear surfaces to provide controlled flexibility in all directions, particularly for self-steering rail car trucks.

U.S. Pat. No. 5,237,933, which is hereby incorporated herein by reference, improved the elastomeric mounting by the addition of a single metal shim sandwiched between two elastomeric layers. While the shear pad described in the '933 patent and similar shear pads with multiple metal plate and rubber layers tend to have improved service life, a common problem is that they have a thickness of approximately one inch. In contrast, older shear pad assemblies tended to have a thickness in the range of approximately 1.06 inches. This relatively large thickness, if not compensated for elsewhere, will increase the ride height of the car. If one car is equipped with the thicker elastomeric shear pad and an adjacent car is not, the couplers will have different heights, thereby preventing a secure fit between the one car's coupler and the coupler of the adjacent car.

In response to this concern, special side frames having a reduced thickness or profile are used in combination with such thicker mounting assemblies. While this is practicable for a new truck, an existing truck having standard side frames cannot be retrofitted with these thicker shear pads. This is especially problematic in view of recently heightened performance requirements from the American Association of Railroads, such as those outlined in AAR M-976. The thinner shear pads that provide a proper ride height with standard mounting assemblies and side frames typically may not conform to the new performance standards, while thicker mounting assemblies that do conform to the new performance standards provide an improper ride height when coupled with cars having standard trucks.

Accordingly, a general aspect or object of the present invention is to provide a mounting assembly suitable for retrofitting to standard side frames.

Another aspect and object of the present invention is to provide a retrofittable mounting assembly that conforms to current performance standards.

Other aspects, objects and advantages of the present invention, including the various features used in various combinations, will be understood from the following description according to preferred embodiments of the present invention, taken in conjunction with the drawings in which certain specific features are shown.

SUMMARY OF THE INVENTION

In accordance with the present invention, a mounting assembly comprising a shear pad and roller bearing adapter each having a reduced thickness. The shear pad has a substantially metallic lower plate adapted to engage a roller bearing adapter, a substantially metallic upper plate adapted to engage a rail car side frame pedestal, and an elastomeric material, with the total thickness of the metal plates and elastomeric layer being about 0.50", compared to the prior art shear pad thickness of about 1.06". The thickness of the adaptor is reduced about 9/32" from the standard adaptor thickness. Together these thickness reductions provide the benefits of an elastomeric shear pad without introducing coupler height mismatches and without the need for altering standard side frames.

According to another aspect of the present invention, a low profile mounting assembly is provided with a roller bearing adapter including a bottom surface adapted to engage a rail car axle bearing and a top surface defining a recess. A shear pad assembly is provided with a plate having a top surface adapted to engage a rail car side frame pedestal and a bottom surface defining a downwardly extending projection adapted to be received by the recess to prevent disengagement of the roller bearing adapter and the shear pad assembly. In one embodiment, the roller bearing adapter top surface defines two recesses, each of which is adapted to receive a downwardly extending projection of the shear pad assembly bottom surface.

According to yet another aspect of the present invention, a low profile mounting assembly is provided with a roller bearing adapter including a substantially planar top surface and a bottom surface adapted to engage a rail car axle bearing. A shear pad assembly is provided with an upper plate adapted to engage a rail car side frame pedestal, an intermediate elastomeric layer, and a lower plate defining a central cavity to expose a portion of the elastomeric layer. The lower plate is adapted to engage the roller bearing adapter top surface and at least a portion of the central cavity is adapted to be substantially vertically aligned with a rail car axle bearing engaged by the roller bearing adapter bottom surface.

According to still another aspect of the present invention, a low profile mounting assembly is provided with a roller bearing adapter including a bottom surface adapted to engage a rail car axle bearing and a generally planar top surface defining a plurality of ridges. The mounting assembly also includes a shear pad assembly with a plate having a top surface adapted to engage a rail car side frame pedestal and a bottom surface defining a downwardly extending projection. The projection is substantially comprised of an elastomeric material and adapted to bear against the ridges to prevent disengagement of the roller bearing adapter and the shear pad assembly.

The apparatus and methods described herein are particularly well-suited for use in low profile mounting assemblies retrofittable to standard side frames. Of course, it will be appreciated that the mounting assemblies and methods described herein are not limited to low profile configurations, but may find use in thicker mounting assemblies without departing from the scope of the present invention.

DETAILED DESCRIPTION OF THE INVENTION

The embodiments disclosed herein are for the purpose of providing the required description of the present invention. These embodiments, however, are exemplary of the invention, which may be embodied in various forms. Therefore, specific details disclosed herein are not to be interpreted as limiting the invention as defined in the accompanying claims.

Figure 1:
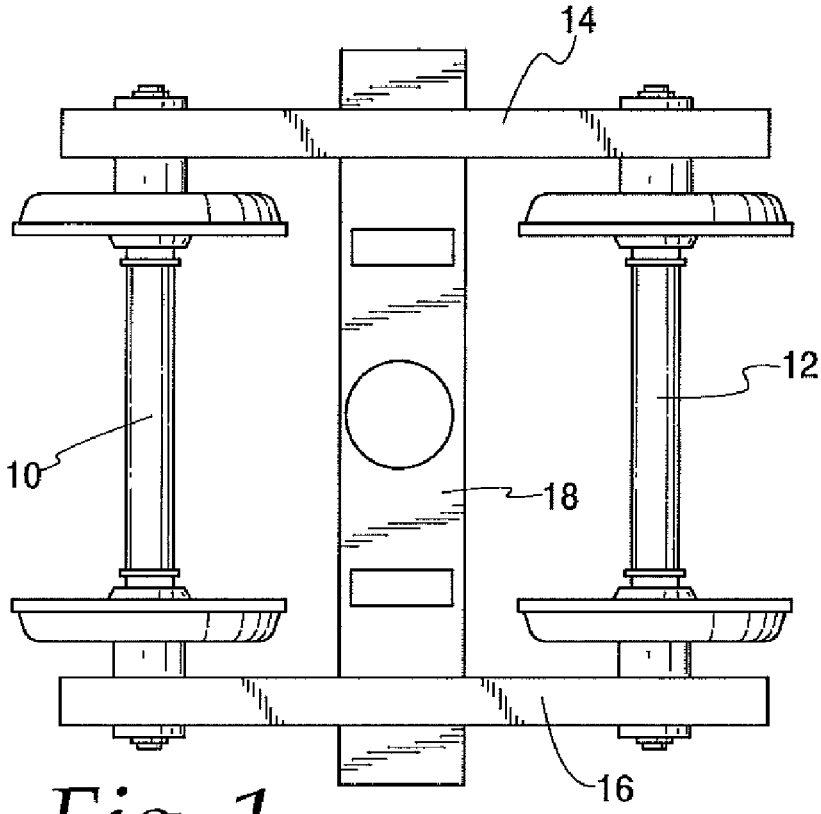
FIG. 1 is a schematic top plan view of a rail car truck illustrating the basic components thereof.
Figure 2:
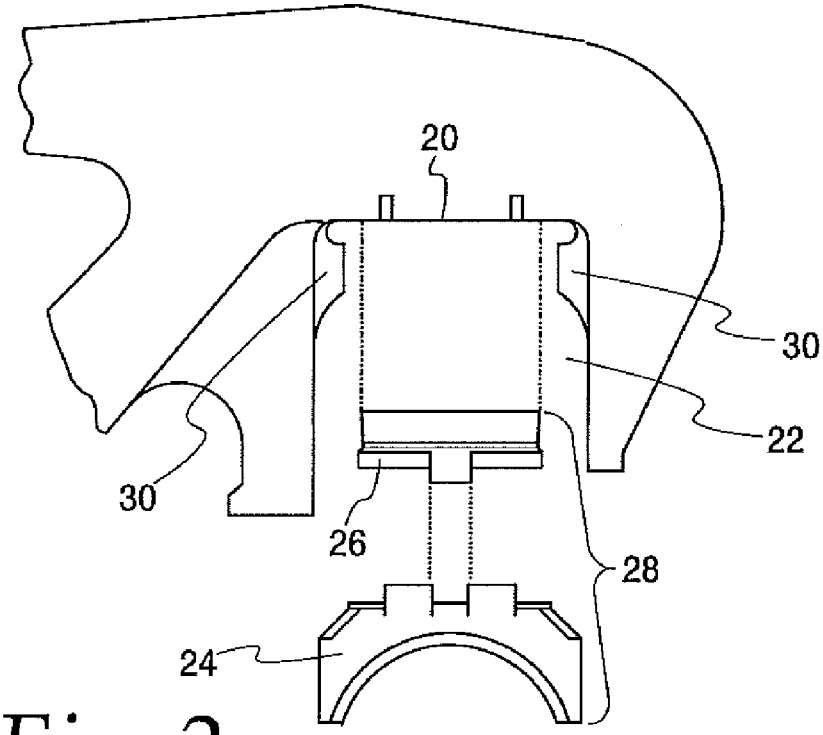
FIG. 2 is a partial exploded side elevation view of the side frame pedestal, shear pad and roller bearing adapter forming a part of the rail car truck of FIG. 1.
Figure 3:
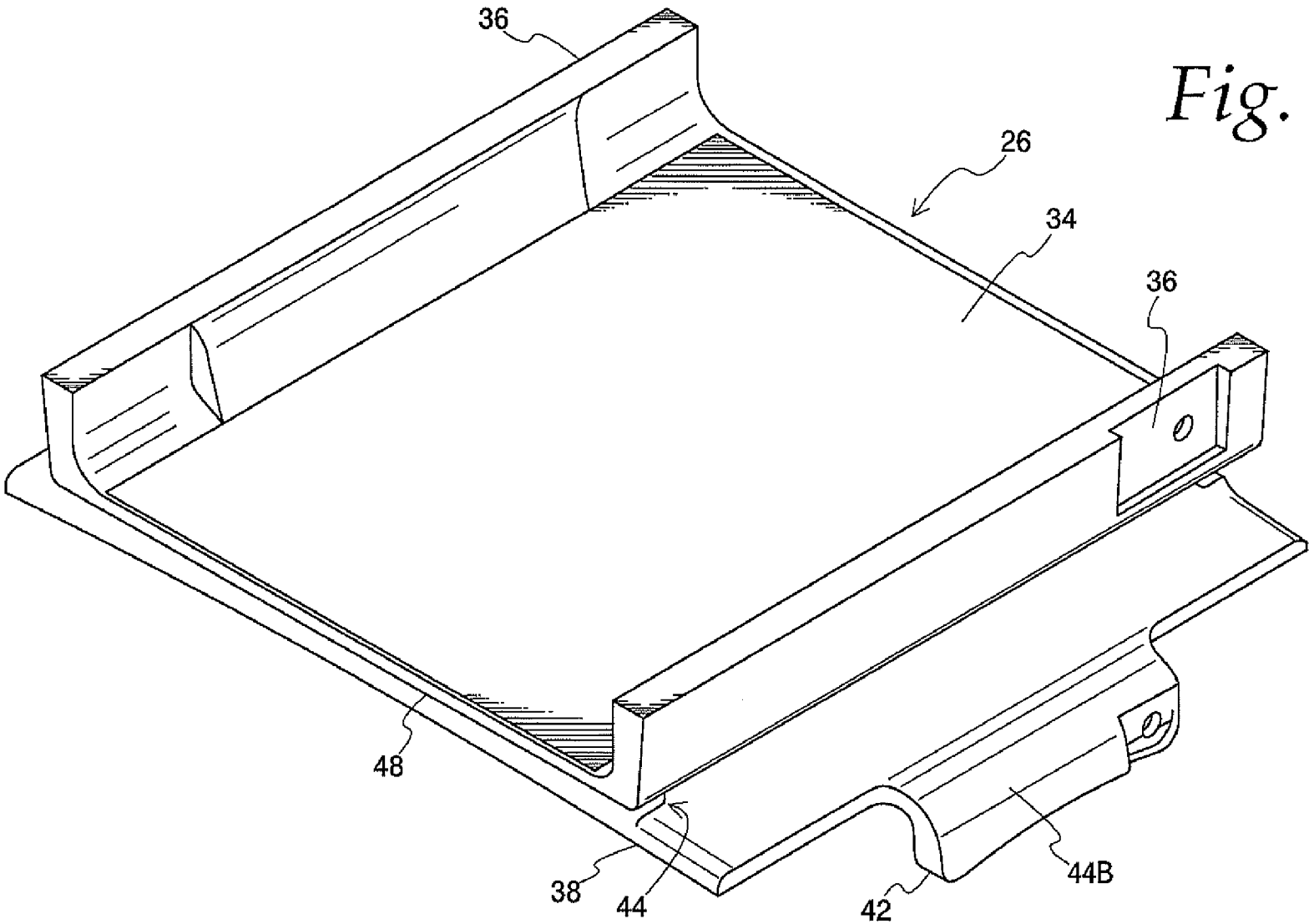
FIG. 3 is a perspective view of a shear pad according to the present invention.
Figure 4:
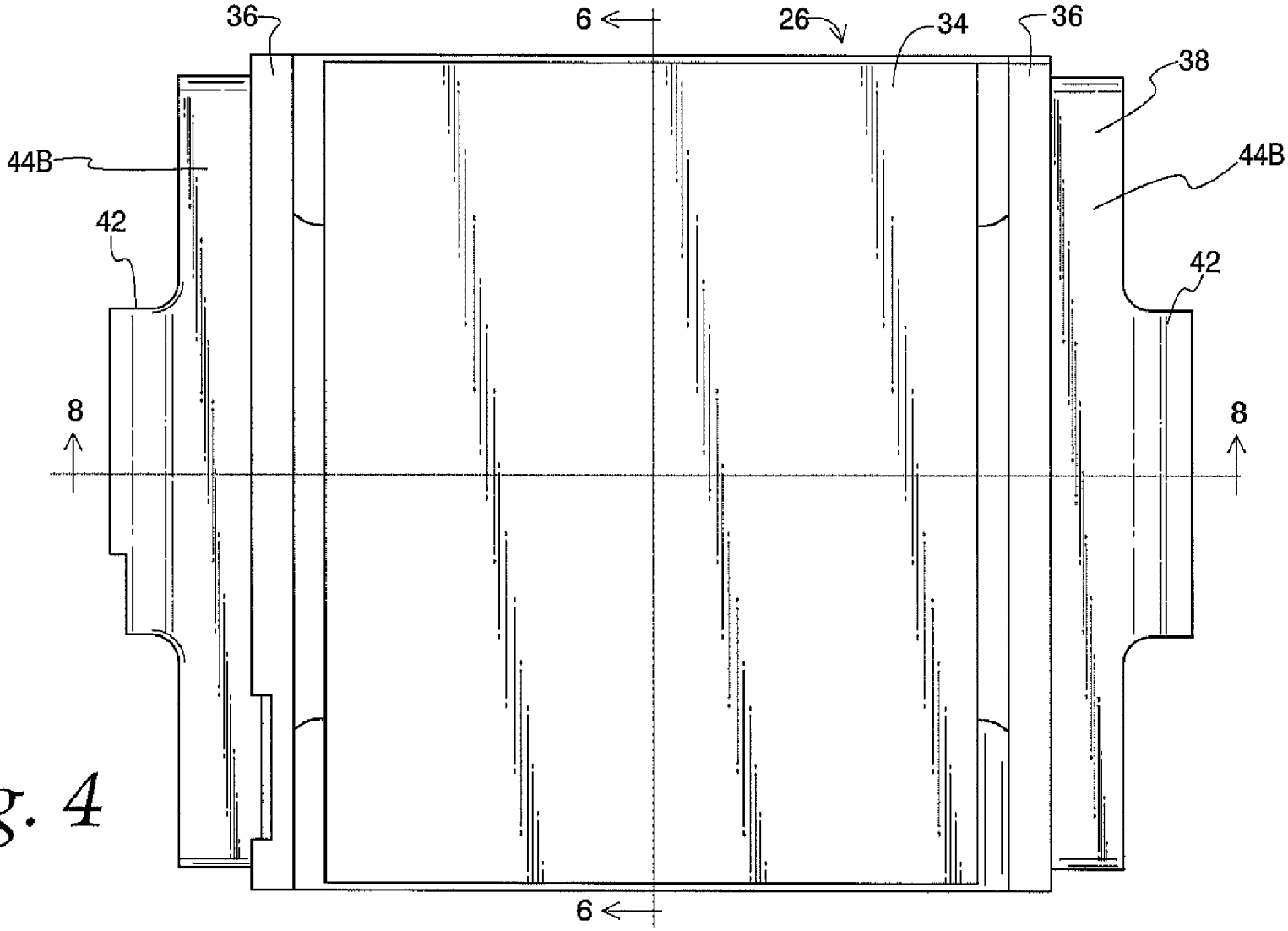
FIG. 4 is a top plan view of the shear pad of FIG. 3.
Figure 5:
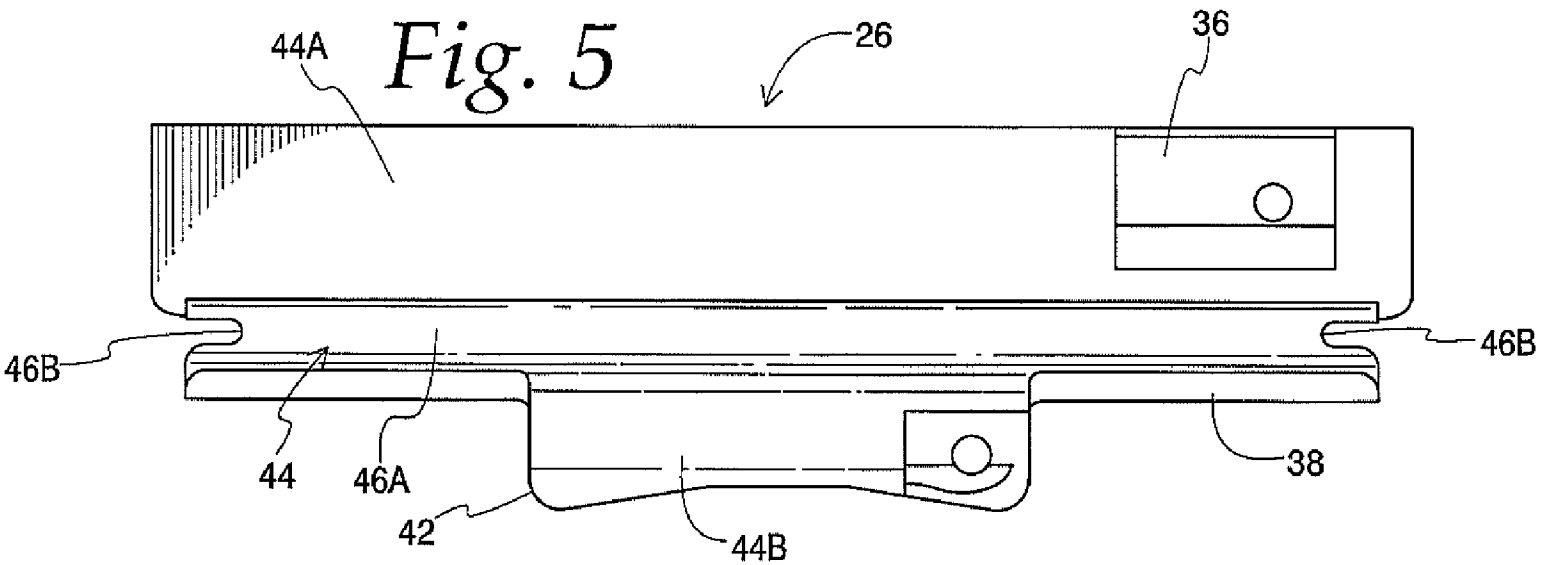
FIG. 5 is a side elevation view of the shear pad.
Figure 6:
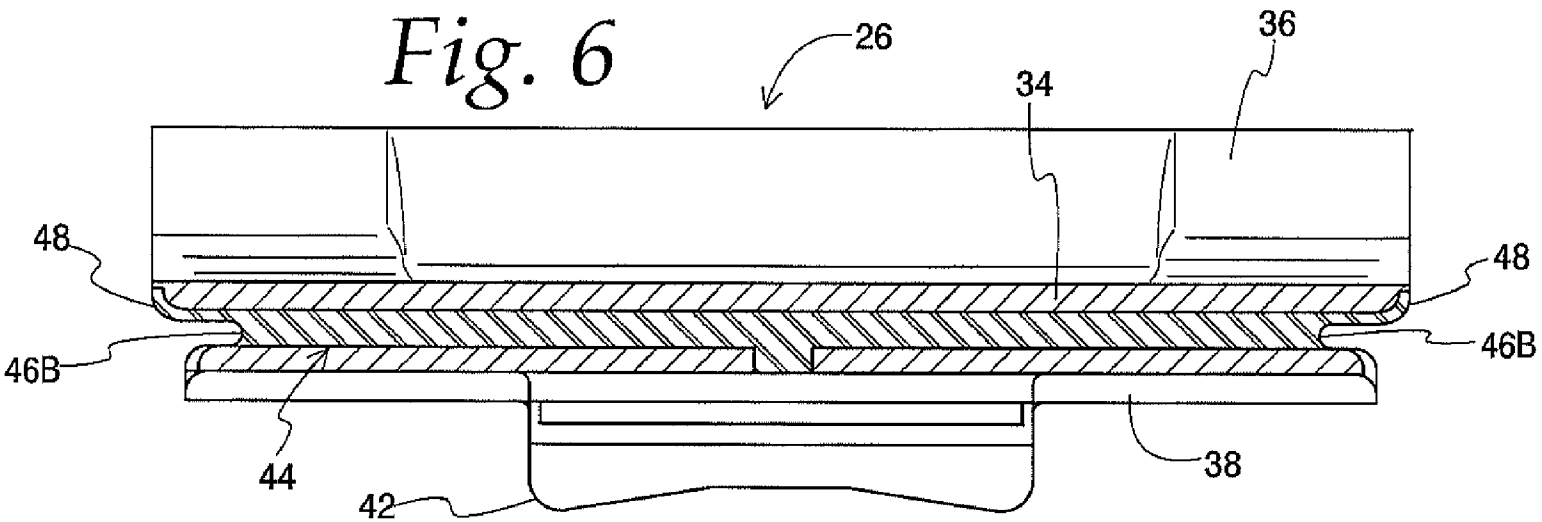
FIG. 6 is a section taken along line 6-6 of FIG. 4.

The present invention relates to a mounting assembly for use in mounting the side frames of a three-piece rail car truck to the roller bearings of the wheelsets. In FIG. 1, a conventional three-piece truck has wheelsets 10 and 12 upon which are supported side frames 14 and 16. A bolster 18 connects the side frames, as is conventional in rail car trucks of this design. The side frames include side frame pedestals 20 (FIG. 2) which define an opening 22. Within the opening 22 there will be located a metallic roller bearing adapter 24 and a shear pad assembly 26. Collectively the adapter 24 and shear pad 26 will be referred to herein as a mounting assembly 28. A pair of thrust lugs 30 extends away from the side frame pedestal 20 and into the opening 22. The shear pad is disposed in the space between the thrust lugs. The difference between the thrust lug spacing and the length of the shear pad defines the available deflection d of the shear pad. The amount of available deflection d is important for reasons that will be explained below. It should be understood that the portion of the side frame, roller bearing adapter, and shear pad assembly shown in FIG. 2 is present at each of the four corners of the truck shown in FIG. 1. The invention is particularly concerned with mounting assemblies that are preferably thinner than prior art metal-elastomer combination mounting assemblies, in which case they can be retrofitted into standard side frames which have standard pedestal dimensions.

Figure 7:
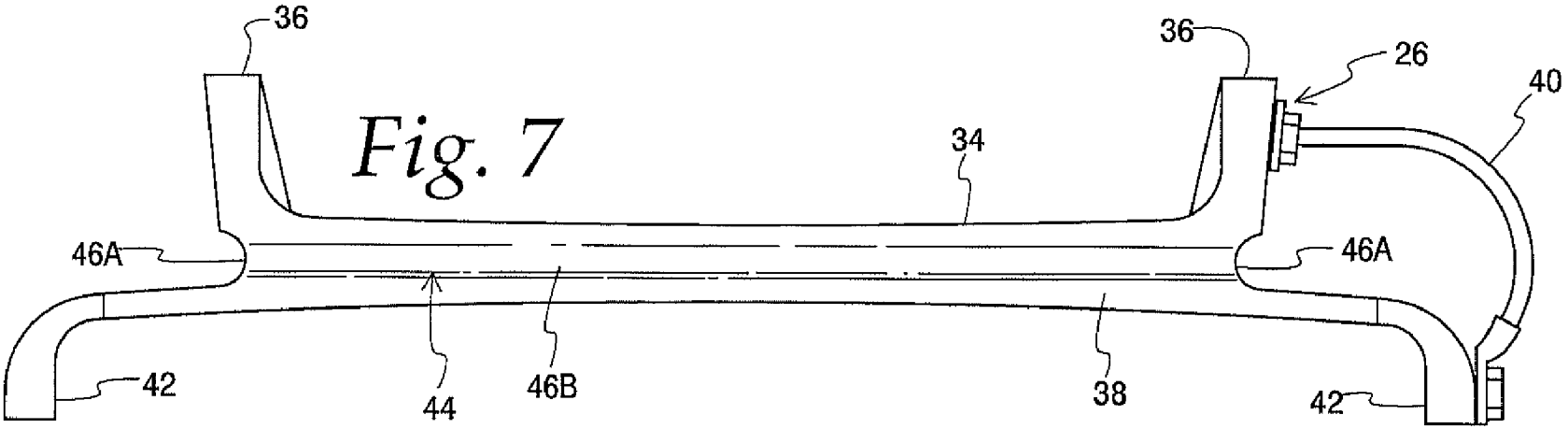
FIG. 7 is an end elevation view of the shear pad.
Figure 8:
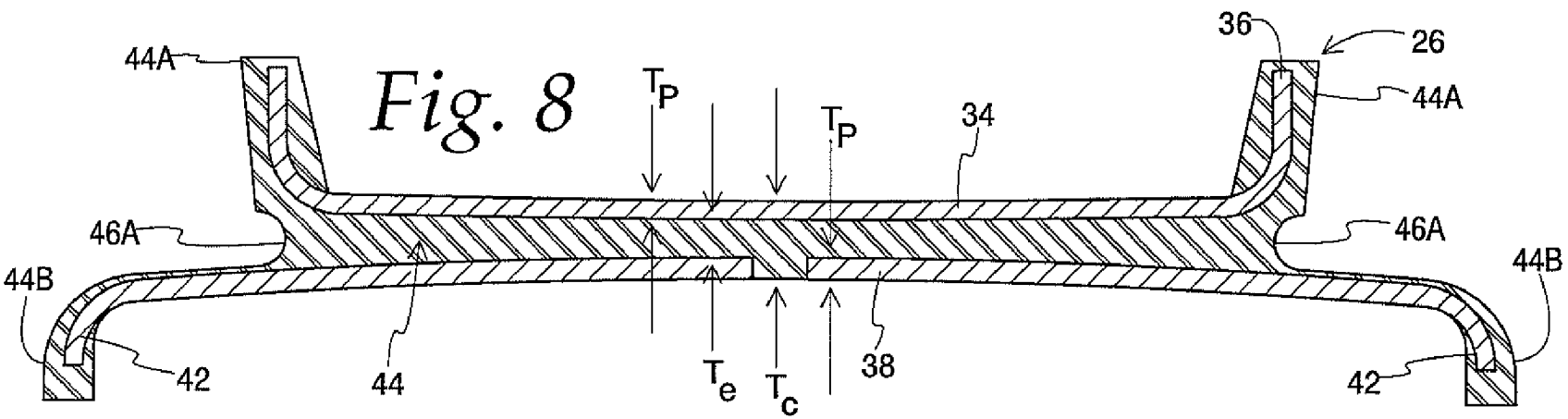
FIG. 8 is a section taken along line 8-8 of FIG. 4.

One way to reduce the profile or thickness of known mounting assemblies is to provide a shear pad assembly 26 with thinner upper and/or lower plates, as seen in FIGS. 3-8. The shear pad assembly 26 includes an upper plate 34, conventionally formed of AISI 1045 steel, and having upturned side edges or flanges 36, with the plate 34 forming a seat for a side frame pedestal 20 (FIG. 2). The shear pad also has a lower steel plate 38 which is spaced from the upper plate 34 by a thickness $T_e$. As seen in FIGS. 7 and 8 the plates have a slightly arched or curved configuration from side to side. The upper and lower plates are connected by a grounding strap 40 according to known design. The side edges of the lower plate 38 each have a tab 42 extending downwardly therefrom. The tabs fit between mating tabs of the roller bearing adaptor 24 for positioning the shear pad assembly 26 with respect to the roller bearing adapter 24, as will be explained below. With this tab configuration, shear pad assemblies according to the present invention may only be used in combination with specially constructed roller bearing adapters and not with standard Class K adapters, which may otherwise lead to performance problems.

Figure 9:
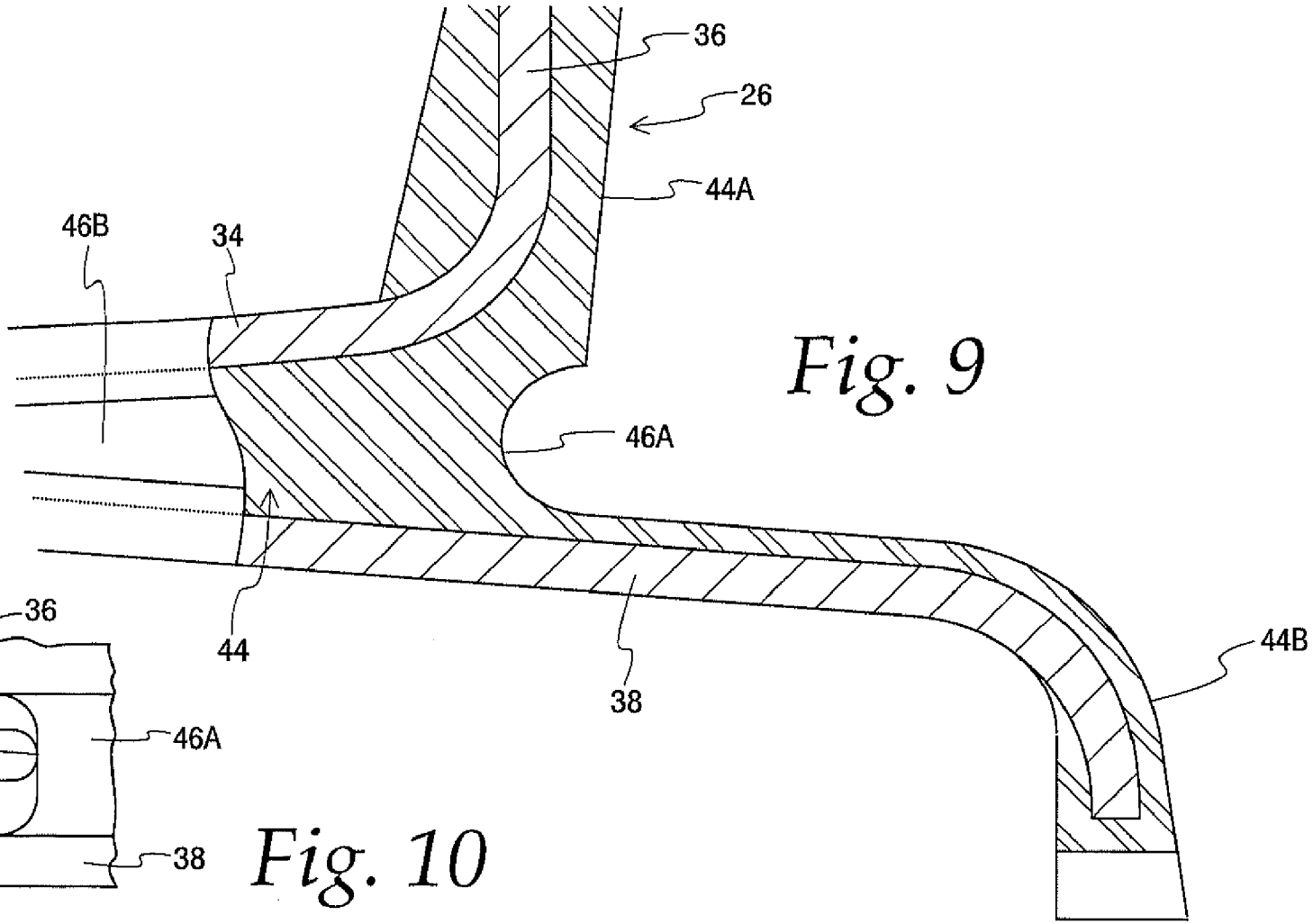
FIG. 9 is an end elevation view of a portion of the shear pad, with parts in section, and on an enlarged scale.
Figure 10:
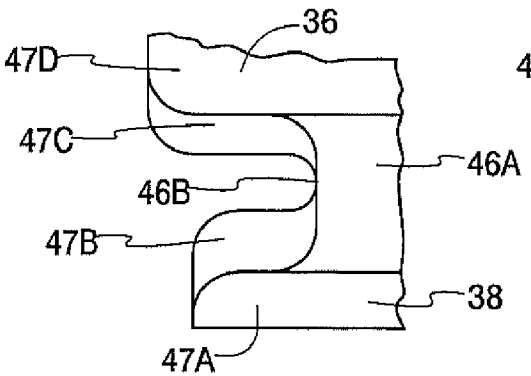
FIG. 10 is an enlarged detail view of the portion encircled in FIG. 5.
Figure 11:
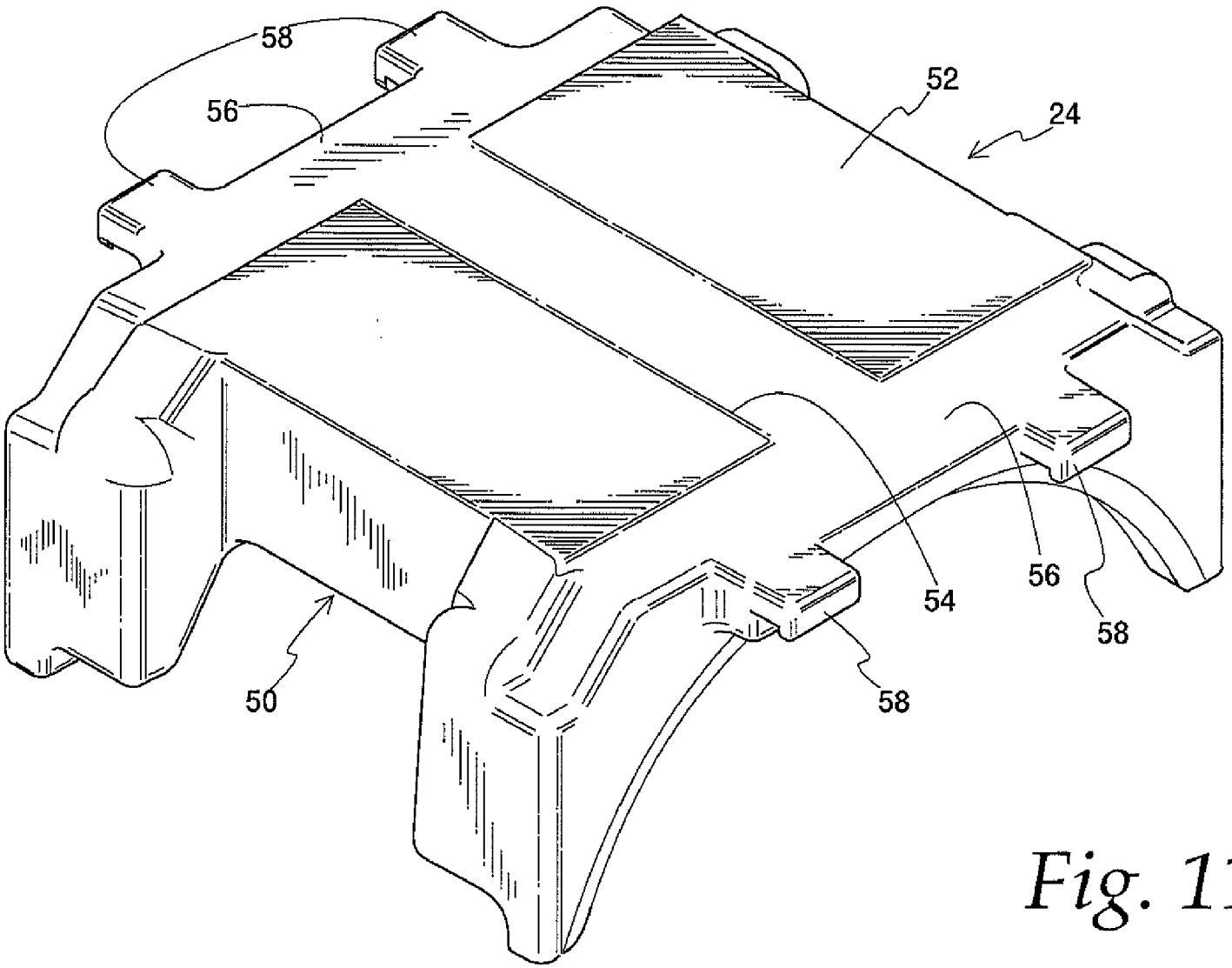
FIG. 11 is a perspective view of a roller bearing adapter suitable for use with the shear pad assembly of FIG. 3.
Figure 12:
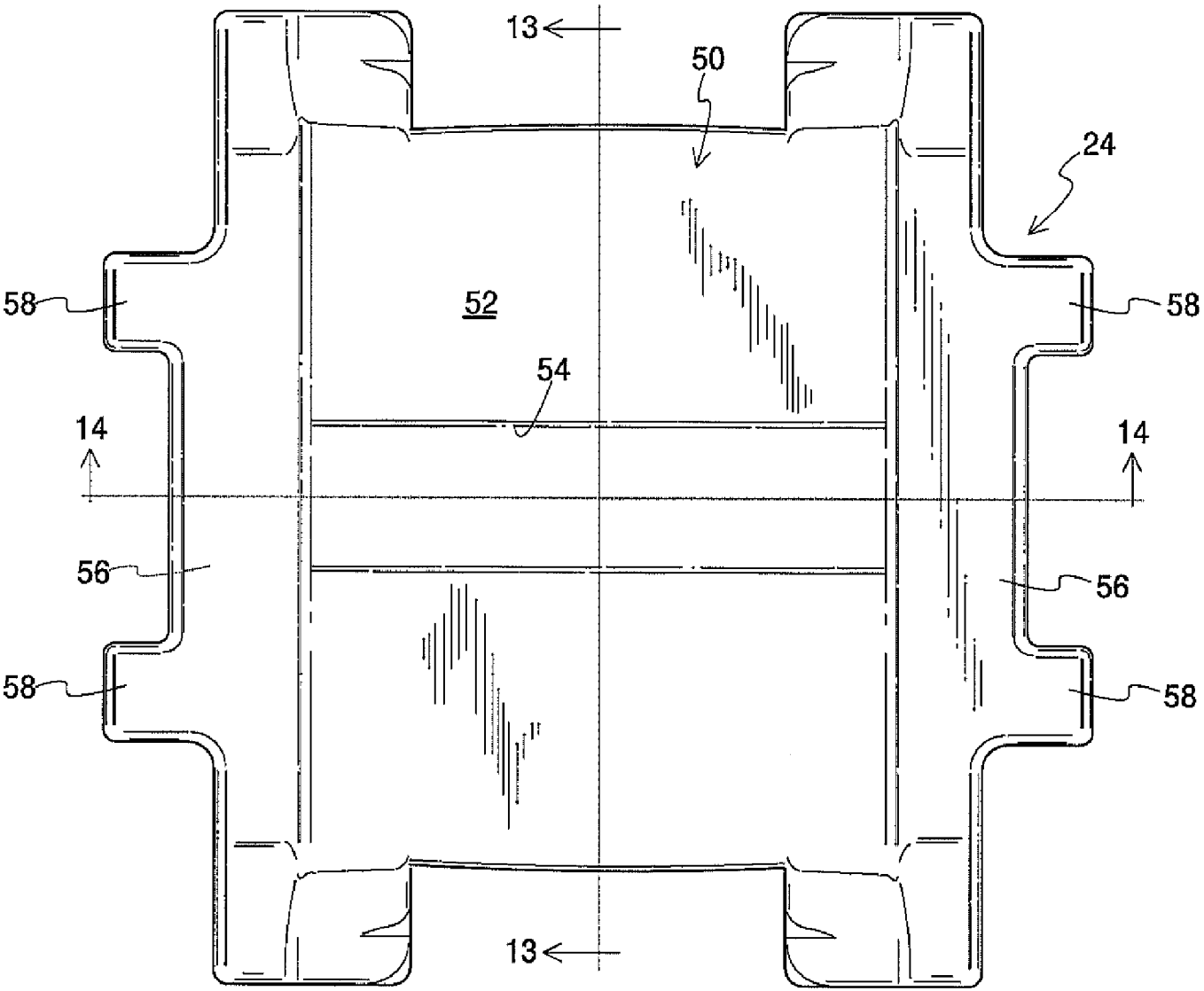
FIG. 12 is a top plan view of the roller bearing adapter of FIG. 11.

Looking at FIG. 8, the space $T_e$ between the upper and lower plates may be filled by a suitable elastomeric layer 44. The elastomeric layer may have a skin 44A that extends up onto the upper plate flanges 36 and a skin 44B that extends down onto the tabs 42. Elastomers to perform this function are well known in the art. Rubber having a Shore A durometer in the range of 65 to 85 is one acceptable material; there could be others. Shear rate for both longitudinal and lateral directions are about equal and within a preferred range of 25,000 lbs/in to 40,000 lbs/in for a loaded car application. In a preferred embodiment, the elastomeric layer 44 has a generally uniform thickness $T_e$ and two side edges 46A and two end edges 46B. The uncompressed thickness $T_e$ is nominally about 15/32". All of the edges 46A, 46B have a concave curvature. In a preferred embodiment, the radius R (FIG. 9) of side edges 46A is about 0.15", although it could be any size that will prohibit the rubber from expanding into tension. The end edges 46B are formed such that the elastomer layer is tangent to the upper and lower plate and the radius r is half the overall distance from the top plate to the bottom plate. This shape has been found to be superior and prevents the elastomer from pinching or going into tension when the elastomer is compressed. By way of explanation of what is seen in FIG. 10, keep in mind that this is a side elevation view and the upper and lower plates are curved from side to side, not flat. Thus, the portion of the elastomer layer 44 shown at 47A is on the side edge of the lower plate 38 and is shown as the foremost portion of the Figure, while the portion 47B is in the background and depicts the elastomer on the curved lower plate as it arches upwardly toward the longitudinal centerline of the shear pad. Similarly, portion 47C is in the background and depicts the downwardly arching portion of the elastomer covering upper plate 34, while portion 47D is foremost in that view and shows the right side edge of the elastomer on upper plate 34.

A uniform thickness improves fixation of the upper plate 34 to the lower plate 38 and improves the performance of the mounting assembly 28 in shear, while the curved edges 46A and 46B increase the bulge area, thereby lowering the shape factor. The shape factor is defined as the loaded area divided by the bulge area. In one embodiment, the shape factor is in the range of approximately 3 to approximately 5. This provides the vertical stiffness required to ensure shearing. It minimizes edge stresses due to pitching (rocking) motions. It does not require a rate plate to increase the shape factor. Generous curved edges are present to minimize tension stresses when the rubber is loaded, for both vertical and horizontal action.

Shear strain is defined as d/t where d=deflection of rubber and t=rubber thickness. As mentioned above, the longitudinal deflection d of the rubber is limited by the available space between the pedestal thrust lugs 30 and the fore and aft edges of the adapter 24. The nominal total amount of this space is 0.09". In the present invention the shear strain is in the range of 0.06 to 0.72 for worn conditions in the longitudinal direction. 75% strains and lower enable a low profile design to achieve longevity comparable to prior art shear pads, but within a smaller design envelope.

Figure 15:
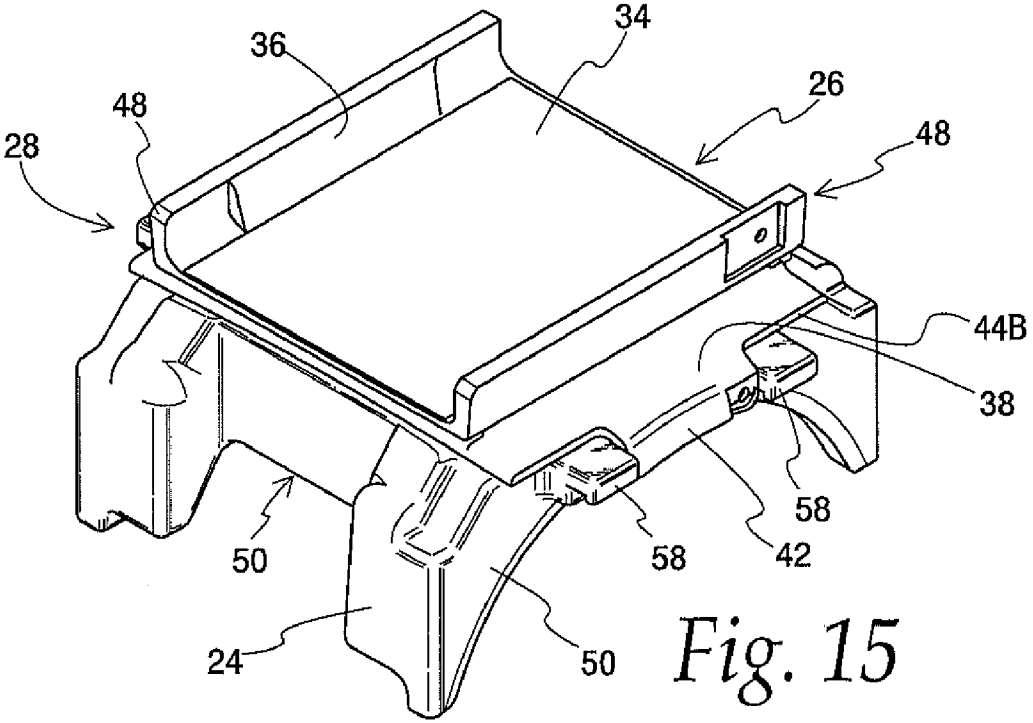
FIG. 15 is a perspective view of the shear pad assembly of FIG. 3 seated on the roller bearing adapter of FIG. 11.
Figure 18:
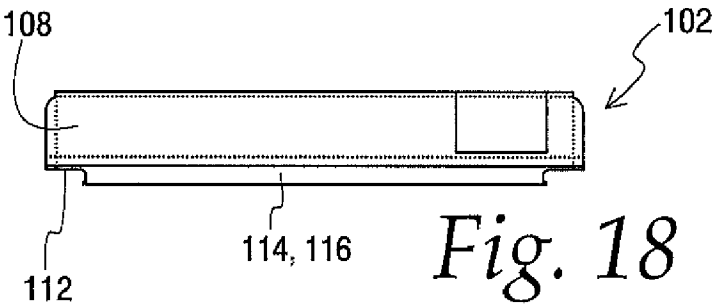
FIG. 18 is a side elevation view of the shear pad assembly of FIG. 16.

Elastomeric material may be present beyond the layer 44 between the upper and lower plates 34 and 38, so as to encapsulate all or a portion of the upper and lower plates. In one embodiment, best illustrated in FIG. 15, the fore and aft ends of the upper plate may be extended by including an amount of elastomeric material 48. By so extending the length of the plate 34, a relatively tight interference fit will be established when the shear pad assembly 26 is pressed between the side frame lugs 30. This interference fit assists in centering the mounting assembly 28 within the opening 22 of the side frame pedestal 20 and reduces the shear that the mounting assembly 28 experiences, thereby allowing for the thickness of the mounting assembly to be decreased without increasing the risk of failure. The elastomeric material at the ends 48 may be provided with a chamfer to simplify installation of the mounting assembly 28.

In one embodiment, the upper plate 34 and the lower plate 38 have a thickness $T_p$ of approximately ⅛". Given the nominal elastomer layer thickness of ¼" this gives the shear pad assembly 26 a total thickness $T_c$ of approximately ½" at the center in an uncompressed condition. It will be appreciated by those skilled in the art that this is significantly thinner than known shear pad assemblies capable of satisfying current AAR performance requirements. For example, some current shear pad assemblies have an upper plate with a ¼" thickness and a lower plate with a ⅜" thickness, with a total thickness of approximately 1.0".

Figure 13:
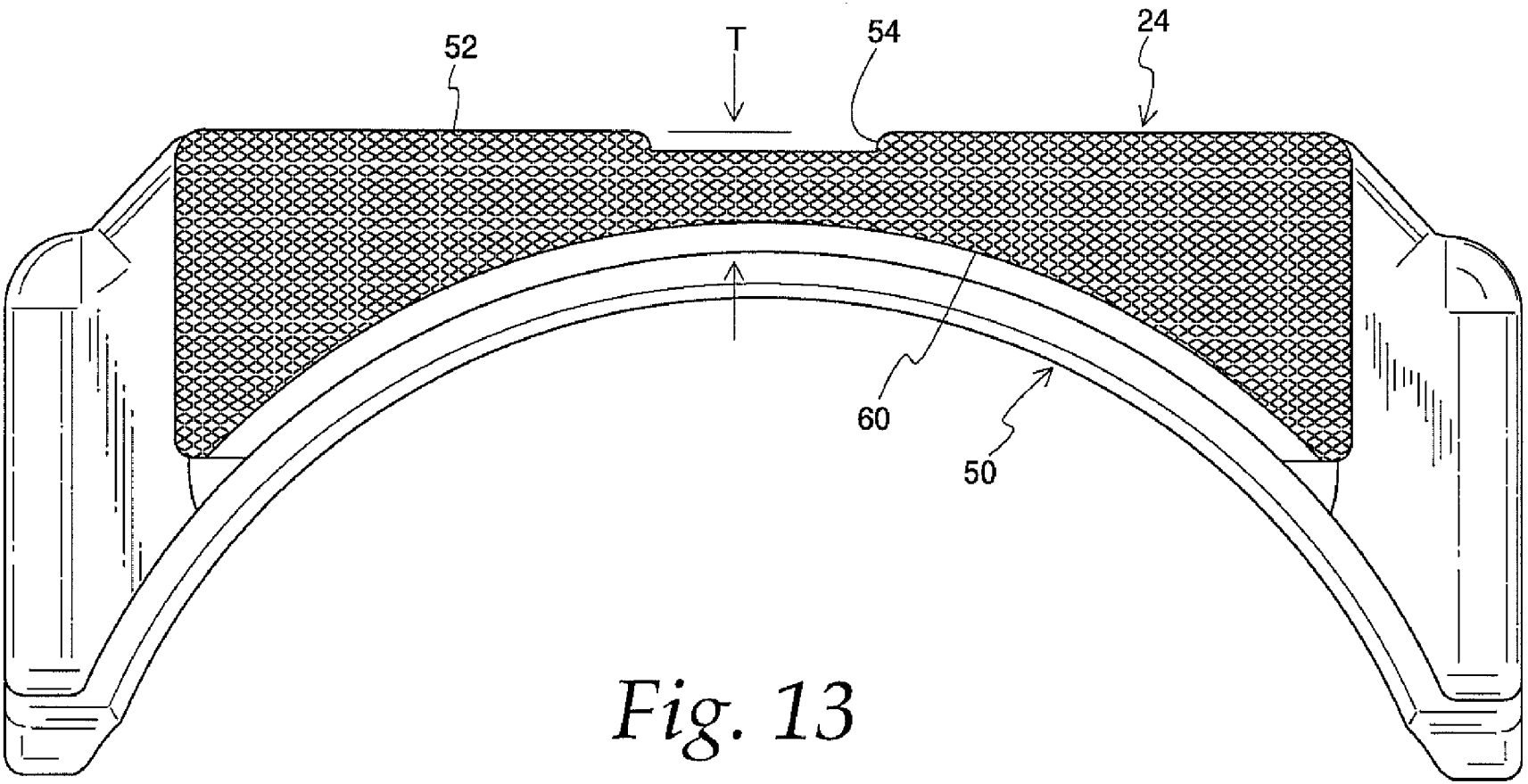
FIG. 13 is a section taken along line 13-13 of FIG. 12.
Figure 14:
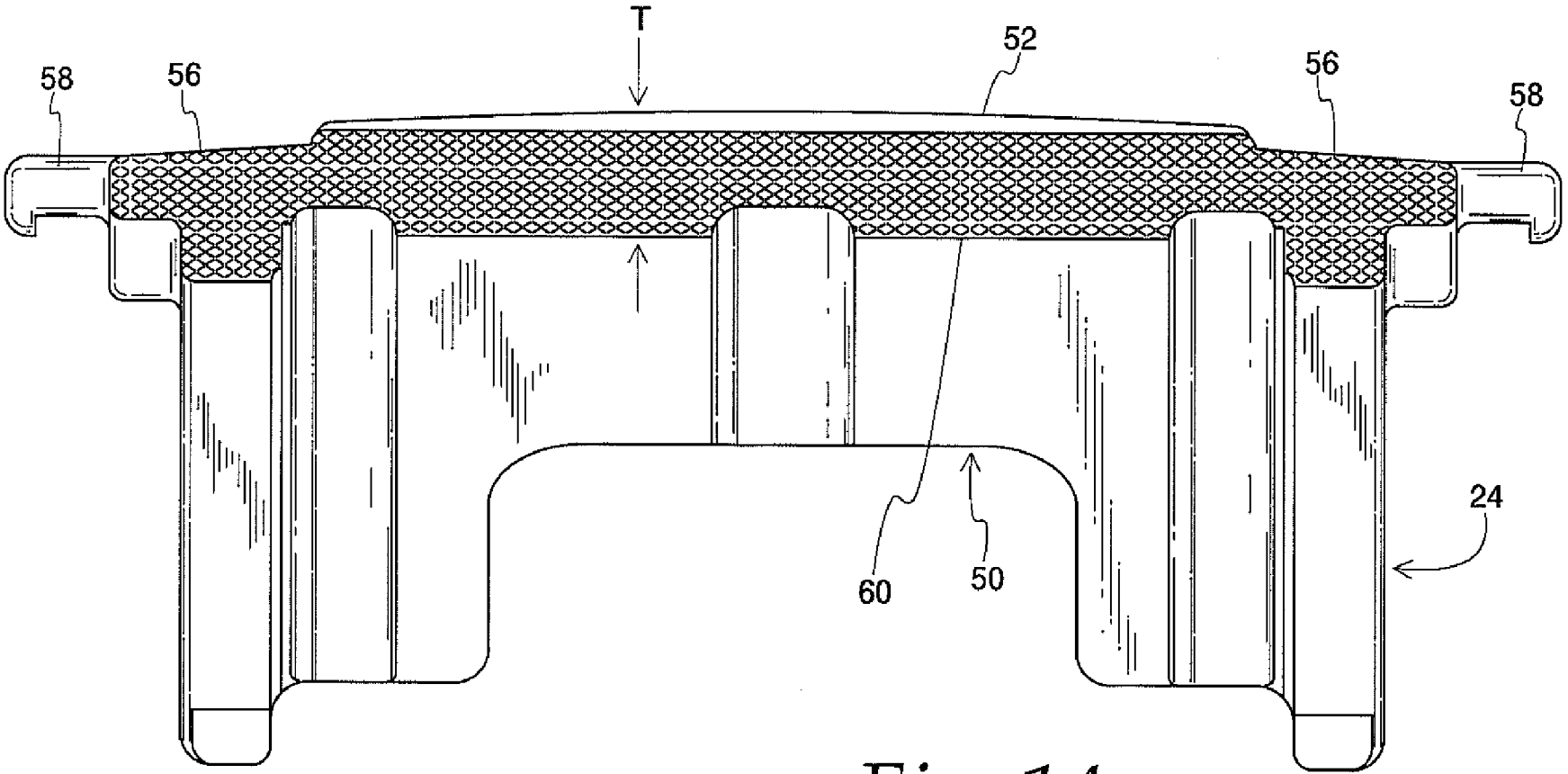
FIG. 14 is a section taken along line 14-14 of FIG. 12.

In addition to the decreased thickness of the shear pad, the present invention also contemplates reducing the thickness of an associated roller bearing adapter 24 by 9/32" to arrive at a total mounting assembly thickness that will not increase coupler height while still meeting the M-976 requirements of the AAR. The roller bearing adapter 24 of the present invention is shown in FIGS. 11-14. It has a central body member 50 with a top surface 52 that is generally flat in the longitudinal direction, as seen in FIG. 13 and slightly arcuate in the lateral direction, as seen in FIG. 14. There is a transverse recess or depression 54 in the top surface 52. The top surface is bounded on either side by extensions 56. As can be seen in FIG. 14 the extensions have a somewhat reduced height compared to the top surface 52. A pair of tabs 58 protrudes from each extension 56. The tabs are spaced to receive therebetween one of the tabs 42 of the shear pad. The underside 60 of the body member 50 has an arcuate shape as seen in FIG. 13. Thus, the bearing adaptor is generally similar to a standard roller bearing adapter except in two respects. First, the dual tabs 58 replace the usual single tab to prevent use of the adaptor with a standard shear pad. Second, the thickness of the body section is reduced compared to the standard adapter. The thickness T shown in FIGS. 13 and 14 is preferably about 0.80". This is approximately 9/32" less than a standard adapter and, together with the reduced thickness of the shear pad, permits the use of an elastomeric shear pad without increasing coupler height with standard side frames.

Alternate configurations of the shear pad are possible. For example, a lighter shear pad could be made be reducing the thickness of the upper and lower plates 34, 38 to about 1/16". This would permit an increase in the elastomer layer thickness to about ⅜" while still keeping the overall shear pad thickness to the desired ½". The increased elastomer thickness would result in greater service life for the elastomer layer. However, with 1/16" thick plates measures will have to be taken to prevent premature failure of the plates. One option is to change the plate material from the standard AISI 1045 steel to 4130 cold drawn and annealed or 4130 hot rolled and annealed or 4140. Another option is to use the standard 1045 steel but alter the configuration of the roller bearing adapter. The width of the top surface 52 of the adapter could be increased so the entire width of the elastomer layer 44 is supported. Along these same lines, the top surface width could be maintained as in the standard bearing adapter but the width of the elastomer layer would be decreased from that shown in FIGS. 7 and 8 so the entire width of the elastomer layer is supported by the width of the top surface 52.

Further alternate embodiments of the shear pad would include a ⅛" bottom plate but with a top plate thickness of 1/16". This would permit an elastomer layer thickness of about 5/16". Another alternative with either arrangement having the 1/16" top plate is to increase the radius of the top plate corners to reduce stress and reduce the chances of the top plate cracking.

Apart from (or in addition to) reducing the thickness of the plates of the shear pad assembly and the adapter, other aspects of the present invention may be applied to provide a low profile mounting assembly. For example, FIGS. 16-21 illustrate another embodiment of a low profile mounting assembly 100. The illustrated mounting assembly 100 comprises a shear pad assembly 102 positioned above a roller bearing adapter 104 and joined thereto by a grounding strap 106. The shear pad assembly 102 comprises a single metal plate 108 having a top surface 110 adapted to engage a rail car side frame pedestal and a bottom surface 112 with an elastomeric layer 114 extending downwardly therefrom. But in contrast to the embodiments of FIGS. 2-10, the shear pad assembly 102 does not include a second or lower plate.

Figure 16:
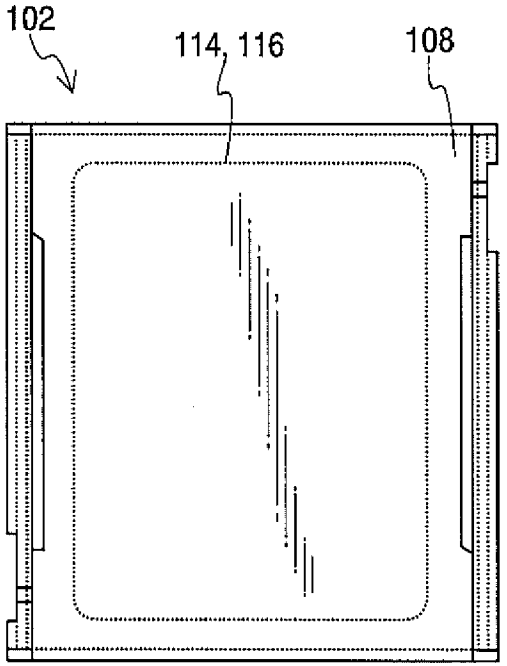
FIG. 16 is a top plan view of an alternate embodiment of a shear pad assembly according to the present invention.
Figure 17:
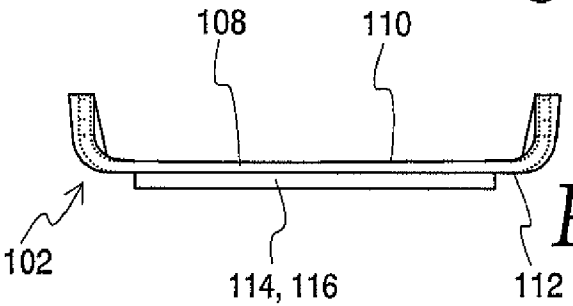
FIG. 17 is an end elevation view of the shear pad assembly of FIG. 16.

Rather than joining the plate 108 to a lower plate, the elastomeric layer 114 is affixed to a substantial portion of the bottom surface 112 of the plate 108 and defines a first projection 116. The projection 116 is illustrated in FIG. 16 as having a generally rectangular perimeter, but other perimeter shapes may also be used without departing from the scope of the present invention. The projection 116 is adapted to be received by a recess 118 defined in a substantial portion of a top surface 120 of the roller bearing adapter 104 (FIGS. 19-21) to prevent disengagement of the adapter 104 and the shear pad assembly 102. The roller bearing adapter 104 also includes an arcuate bottom surface 122 adapted to engage a rail car axle bearing.

Figure 19:
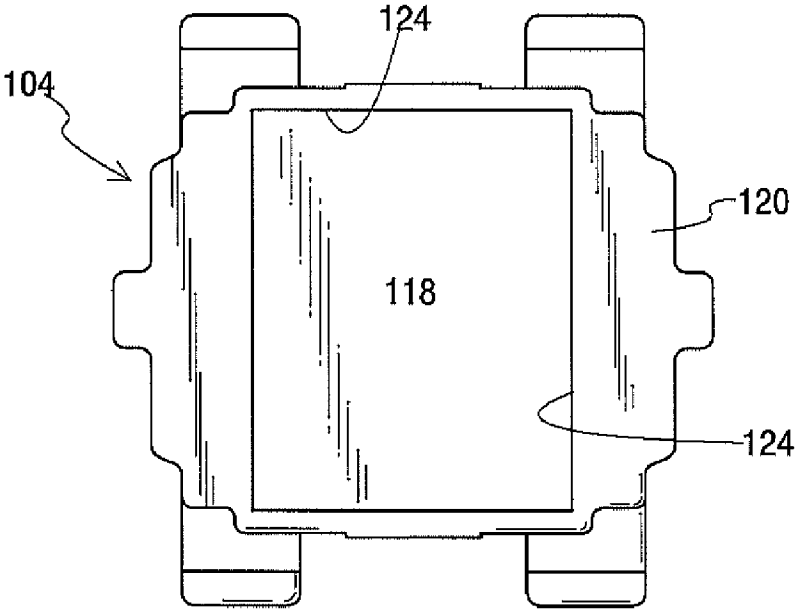
FIG. 19 is a top plan view of a roller bearing adapter suitable for use with the shear pad assembly of FIG. 16.
Figure 20:
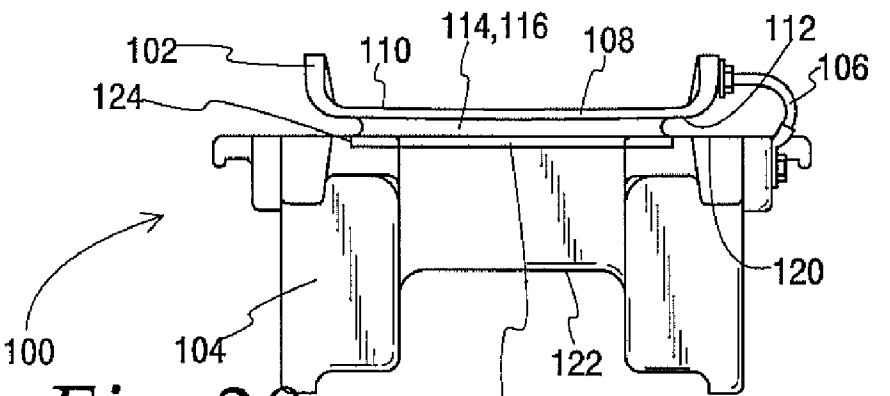
FIG. 20 is an end elevation view of the shear pad assembly of FIG. 16 seated on the roller bearing adapter of FIG. 19.
Figure 21:
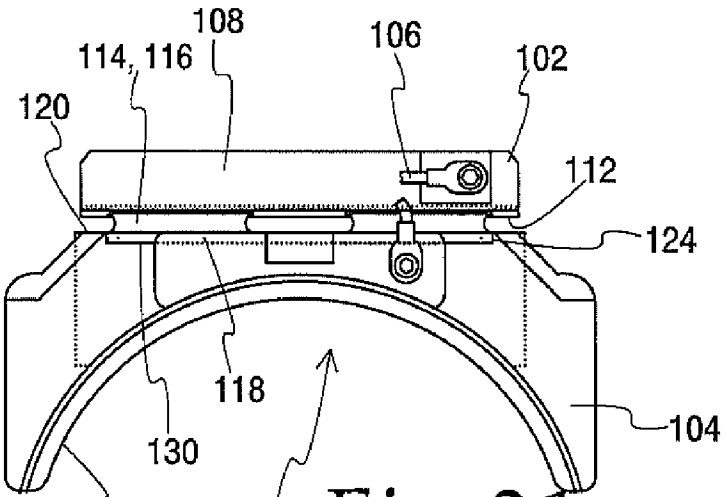
FIG. 21 is a side elevation view of the mounting assembly of FIG. 20.

The recess 118 may be defined by a wall (not illustrated) extending above the adapter top surface 120 or by a depression or indentation extending downwardly from the top surface 120 (FIGS. 19-21). It may be preferred to provide the recess as a downwardly extending depression, as this will further decrease the thickness of the mounting assembly. However, the depth of the recess 118 is preferably less than the thickness of the projection 116, such that the plate bottom surface 112 is supported at least a small distance above the adapter top surface 120.

The recess 118 may be provided according to a number of varying configurations, principally as a loose-fitting configuration that receives the projection 116 and allows it to slide within the recess 118 (upon relative movement of the shear pad assembly and roller bearing adapter) before contacting an edge 124 thereof and deforming, or as a tight-fitting configuration (FIGS. 20 and 21) that substantially prevents sliding movement of the projection 116 within the recess 118 before such deformation.

The recess 118 is structurally and functionally distinct from the transverse central recess 54 (FIG. 11) according to known adapter design. The transverse central recess 54 has open lateral ends, is vertically aligned with a roller bearing on which the roller bearing adapter is mounted, and is intended to shift the side frame load away from the center of the bearing, which distributes the load over a greater number of roller bearing rollers and enhances the durability of the roller bearing. In a typical mounting assembly, the shear pad assembly seats upon the roller bearing adapter and covers the central recess 54 without extending into it. Further, transverse central recess 54 would not provide an acceptable retention function with the projection 116, because the open lateral ends would allow completely unencumbered lateral movement of the shear pad with respect to the adapter. Hence, transverse central recess 54 provides a load distribution function, rather than a retention function.

Figure 22:
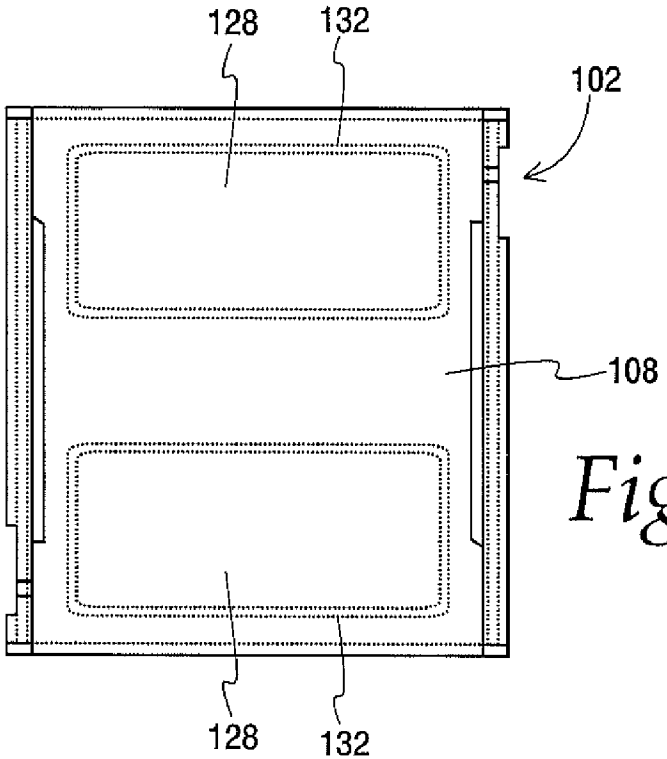
FIG. 22 is a top plan view of a further alternate embodiment of a shear pad assembly according to the present invention.
Figure 24:
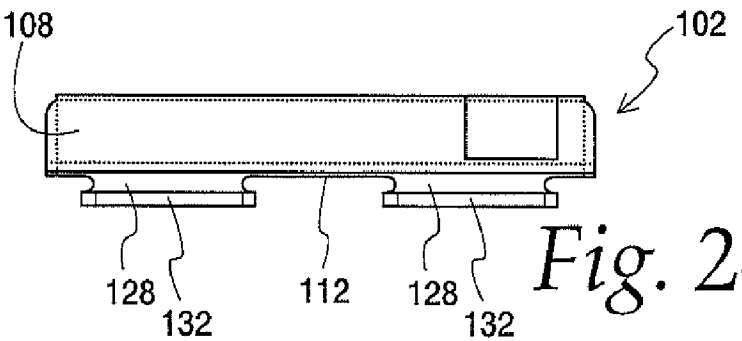
FIG. 24 is a side elevation view of the shear pad assembly of FIG. 22.
Figure 23:
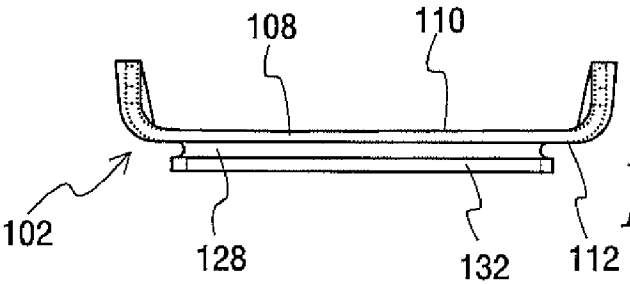
FIG. 23 is an end elevation view of the shear pad assembly of FIG. 22.
Figure 25:
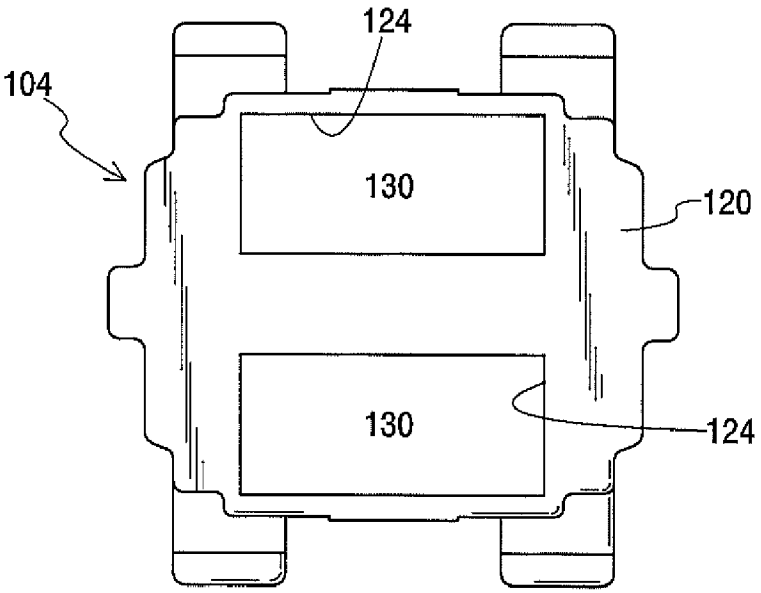
FIG. 25 is a top plan view of a roller bearing adapter suitable for use with the shear pad assembly of FIG. 22.
Figure 27:
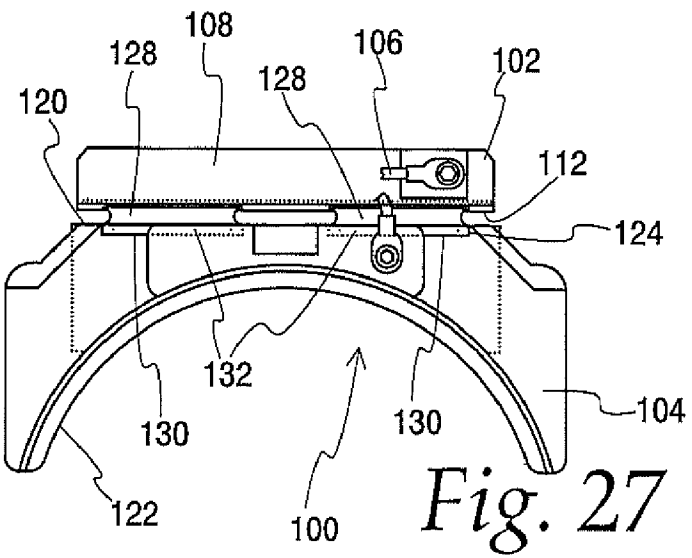
FIG. 27 is a side elevation view of the mounting assembly of FIG. 26.
Figure 26:
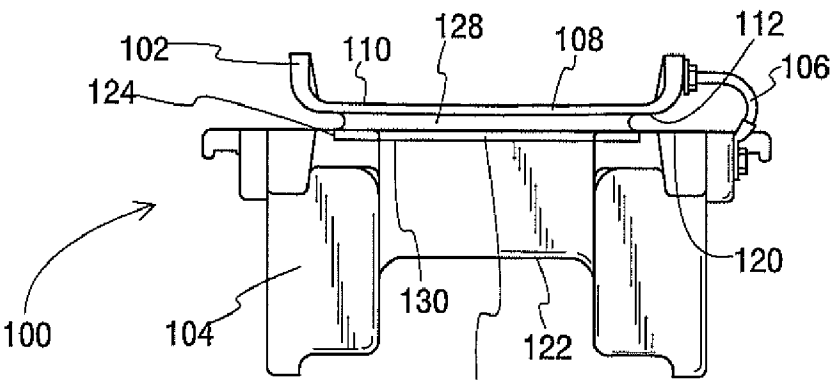
FIG. 26 is an end elevation view of the shear pad assembly of FIG. 22 seated on the roller bearing adapter of FIG. 25.

FIGS. 22-27 illustrate a variation of the embodiment of FIGS. 16-21. Rather than a single elastomeric projection, the plate 108 has a bottom surface 112 with a plurality of smaller projections 128 extending away therefrom. While FIGS. 22-24 show a shear pad plate 108 with two identical projections 128, there may be more than two projections and the projections may have different configurations, although it may be preferred for all of the projections to have a substantially identical thickness. The projections 128 may be adapted to be received by a single recess defined in a top surface 120 of a roller bearing adapter 104 (as in FIG. 19) or in separate recesses 130 (FIGS. 25-27). As with the embodiment of FIGS. 16-21, each projection 128 may be adapted to fit tightly or loosely within the associated recess 130, depending on the desired amount of slippage between the shear pad assembly 102 and the roller bearing adapter 104. Preferably, the recesses 130 are positioned such that they will not tend to increase the deflection of the roller bearing adapter 104. The configuration of FIG. 25 has been found to achieve this goal, but those of ordinary skill in the art will appreciate that other configurations which avoid increasing deflection are also possible.

In either embodiment of FIGS. 16-27, the projections may include a metallic pad 132 (FIGS. 22-24) affixed to the bottom of the elastomeric projections. While this will increase the thickness of the mounting assembly, it will also tend to increase the durability. By way of example and not by limitation, the shear pad plate 108 has a generally uniform thickness in the range of approximately 0.14" to 0.18", the elastomeric material 114 has a generally uniform uncompressed thickness in the range of approximately 0.23" to 0.27", the metallic pads 132 have a generally uniform thickness of approximately 0.19", and the recesses 130 also have a generally uniform depth of approximately 0.19". By such a configuration, the pads 132 occupy the height of the recesses 130 to substantially prevent the elastomeric material 114 from bearing against the recess edges 124 during relative movement of the shear pad assembly 102 and the roller bearing adapter 104.

Figure 28:
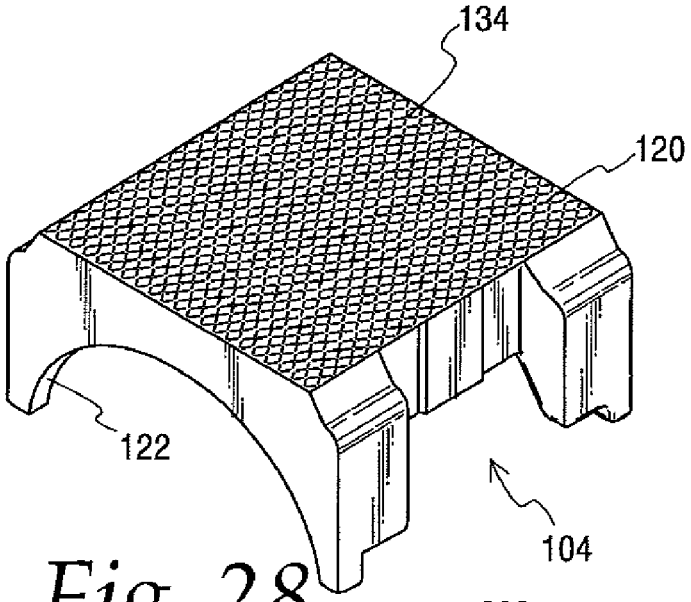
FIG. 28 is a perspective view of a roller bearing adapter suitable for use with the shear pad assemblies of FIGS. 16 and 22.

According to yet another variation of the embodiment of FIGS. 16-21, the top surface 120 of the roller bearing adapter 104 is generally planar (FIG. 28) instead of having a retention recess or a load-distributing transverse channel. The elastomeric projection 116 of the shear pad assembly 102 bears against the adapter top surface 120 and is discouraged from sliding away from the top surface 120 by a relatively high friction finish. In one embodiment, the top surface 120 is provided with a plurality of corrugations or ridges 134 (FIG. 28) that operate to give the top surface 120 a greater friction than a purely planar surface. Preferably, the ridges 134 have a generally uniform maximum height to prevent the projection 116 and associated shear pad assembly 102 from seating unevenly and becoming canted. Also, it may be preferred for the ridges 134 to be arranged in a generally uniform and/or symmetrical distribution to further discourage the shear pad assembly 102 from seating unevenly. The ridges 134 may be provided as metallic or polymeric extensions of the roller bearing top surface 120. If the ridges are metallic, it is preferred to provide a polymeric projection of the shear pad assembly 102, while it is preferred to provide a lower metallic pad for the shear pad projection if the ridges are polymeric.

Figure 29:
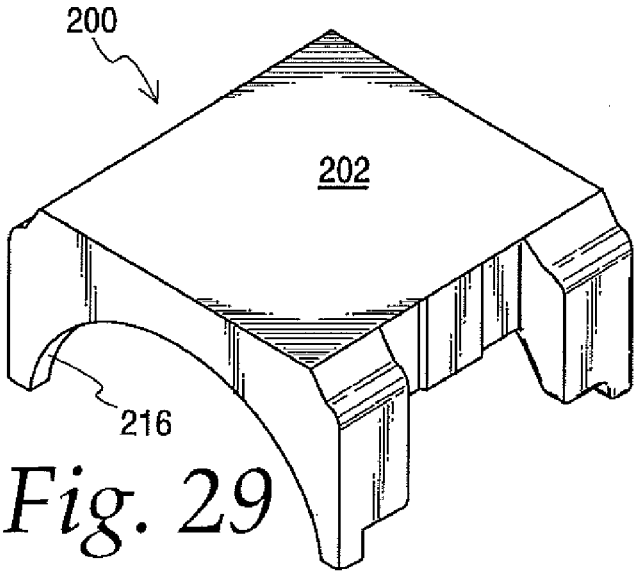
FIG. 29 is a perspective view of a roller bearing adapter having a substantially planar top surface.
Figure 30:
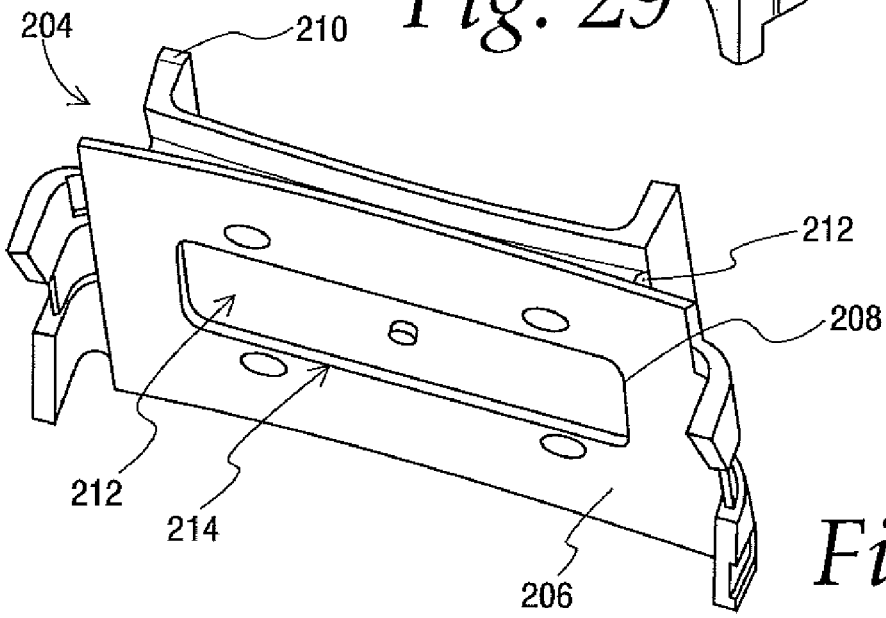
FIG. 30 is a bottom perspective view of a shear pad assembly suitable for use with the roller bearing adapter of FIG. 29.

FIGS. 29-30 illustrate another aspect of the present invention including a roller bearing adapter 200 having a generally planar top surface 202. Rather than providing an adapter top surface with a load-distributing transverse channel 54 (FIG. 11), a shear pad assembly 204 includes a lower plate 206 defining a central cavity 208 (FIG. 30). The substantially metallic lower plate 206 is affixed to a substantially metallic upper plate 210 (incorporating either a known design or one of the inventive designs described herein) by an elastomeric or rubber layer 212. The central cavity 208 exposes a portion of the rubber layer 212 and may include an undercut or chamfered perimeter 214 to decrease rubber corner strains. Preferably, the central cavity 208 is laterally elongated to mimic the general configuration of known transverse adapter channels.

In use, the lower plate 206 of the shear pad assembly 204 is seated on the substantially planar top surface 202 of the roller bearing adapter 200 to collectively define a mounting assembly. The mounting assembly is placed within a side frame opening, with the upper plate 210 of the shear pad assembly 204 engaging the side frame pedestal and a bottom surface 216 of the roller bearing adapter 200 engaging an axle bearing. The central cavity 208 of the shear pad lower plate 206 is vertically aligned with the bearing to shift the side frame load away from the center of the bearing, which distributes the load over a greater number of roller bearing rollers and enhances the durability of the roller bearing.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein. For these reasons, the scope of the invention is not limited to the above description but is as set forth in the following claims.

The invention claimed is:

1. A low profile mounting assembly for use between a rail car side frame pedestal and a rail car axle bearing, comprising:

a roller bearing adapter including a bottom surface adapted to engage a rail car axle bearing and a top surface defining a single recess; and a shear pad assembly including a plate having a top surface adapted to engage a rail car side frame pedestal and a bottom surface defining a downwardly extending single projection adapted to be received by the recess to prevent disengagement of the roller bearing adapter and the shear pad assembly, wherein at least one edge of the projection is spaced inwardly from a corresponding edge of the shear pad assembly.

2. The low profile mounting assembly of claim 1, wherein said recess comprises a substantial portion of the roller bearing adapter top surface and said projection comprises a substantial portion of the shear pad assembly bottom surface.

3. A low profile mounting assembly for use between a rail car side frame pedestal and a rail car axle bearing, comprising:

a roller bearing adapter including a bottom surface adapted to engage a rail car axle bearing and a top surface defining a first recess; and a shear pad assembly including a plate having a top surface adapted to engage a rail car side frame pedestal and a bottom surface defining a downwardly extending first projection adapted to be received by the first recess to prevent disengagement of the roller bearing adapter and the shear pad assembly, wherein said roller bearing adapter and said shear pad assembly are substantially comprised of a metallic material and said first projection is comprised of an elastomeric material.

4. The low profile mounting assembly of claim 1, wherein said projection further comprises a metallic pad attached to the shear pad assembly by an elastomeric material.

5. The low profile mounting assembly of claim 4, wherein the metallic pad has a generally uniform thickness, the recess has a generally uniform depth, and the pad thickness is substantially equal to the recess depth.

6. A low profile mounting assembly for use between a rail car side frame pedestal and a rail car axle bearing, comprising:

a roller bearing adapter including a bottom surface adapted to engage a rail car axle bearing and a top surface defining a first recess; and a shear pad assembly including a plate having a top surface adapted to engage a rail car side frame pedestal and a bottom surface defining a downwardly extending first projection adapted to be received by the first recess to prevent disengagement of the roller bearing adapter and the shear pad assembly, wherein said first projection is comprised of a deformable material and adapted to be substantially immovably received by the first recess prior to deformation upon relative movement of the shear pad assembly and the roller bearing adapter.

7. A low profile mounting assembly for use between a rail car side frame pedestal and a rail car axle bearing, comprising:

a roller bearing adapter including a bottom surface adapted to engage a rail car axle bearing and a top surface defining a first recess; and a shear pad assembly including a plate having a top surface adapted to engage a rail car side frame pedestal and a bottom surface defining a downwardly extending first projection adapted to be received by the first recess to prevent disengagement of the roller bearing adapter and the shear pad assembly, wherein said first projection is comprised of a deformable material and adapted to be movably received by the first recess prior to deformation upon relative movement of the shear pad assembly and the roller bearing adapter.

8. A low profile mounting assembly for use between a rail car side frame pedestal and a rail car axle bearing, comprising:

a roller bearing adapter including a bottom surface adapted to engage a rail car axle bearing and a top surface defining a first recess; and a shear pad assembly including a plate having a top surface adapted to engage a rail car side frame pedestal and a bottom surface defining a downwardly extending first projection adapted to be received by the first recess to prevent disengagement of the roller bearing adapter and the shear pad assembly, further comprising a second recess defined by the roller bearing adapter top surface and a second projection extending downwardly from the shear pad assembly bottom surface, wherein the second projection is adapted to be received by the second recess to prevent disengagement of the roller bearing adapter and the shear pad assembly.

9. A low profile mounting assembly for use between a rail car side frame pedestal and a rail car axle bearing, comprising:

a roller bearing adapter including a substantially planar top surface and a bottom surface adapted to engage a rail car axle bearing; and a shear pad assembly including an upper plate adapted to engage a rail car side frame pedestal, an intermediate elastomeric layer, and a lower plate defining a central cavity to expose a portion of the elastomeric layer, wherein the lower plate is adapted to engage the roller bearing adapter top surface and at least a portion of the central cavity is adapted to be substantially vertically aligned with a rail car axle bearing engaged by the roller bearing adapter bottom surface.

10. The low profile mounting assembly of claim 9, wherein the central cavity includes an undercut or chamfered perimeter.

* * * * *